US006662508B1

(12) United States Patent
Else

(10) Patent No.: US 6,662,508 B1
(45) Date of Patent: Dec. 16, 2003

(54) COVER ASSEMBLY

(75) Inventor: Robert Arthur Else, Castle Donington (GB)

(73) Assignee: Terraplas PLC., Derby (GB)

( * ) Notice: Subject to any disclaimer, the term of this patent is extended or adjusted under 35 U.S.C. 154(b) by 0 days.

(21) Appl. No.: 09/914,108

(22) PCT Filed: Mar. 30, 2000

(86) PCT No.: PCT/GB00/01227

§ 371 (c)(1),
(2), (4) Date: Aug. 23, 2001

(87) PCT Pub. No.: WO00/59589

PCT Pub. Date: Oct. 12, 2000

(30) Foreign Application Priority Data

Jun. 4, 1999 (GB) ..... 9907607

(51) Int. Cl.[7] ..... E04F 15/02

(52) U.S. Cl. ..... 52/177; 52/582.2; 52/592.1; 404/40

(58) Field of Search ..... 52/177, 582.2, 52/591.1, 592.1, 403.1, 309.9, 309.11, 404.1, 404.4; 15/215, 216, 238, 239; 404/34, 35, 40, 41, 44; 16/225

(56) References Cited

U.S. PATENT DOCUMENTS

| | | | | | |
|---|---|---|---|---|---|
| 2,019,692 | A | * | 11/1935 | Mueller | 160/229.1 |
| 3,175,476 | A | * | 3/1965 | Franks | 404/35 |
| 4,726,707 | A | * | 2/1988 | Newton | 404/25 |
| 4,930,286 | A | * | 6/1990 | Kotler | 52/177 |
| 5,234,738 | A | * | 8/1993 | Wolf | 428/120 |
| 5,333,423 | A | * | 8/1994 | Propst | 52/126.6 |
| 5,572,842 | A | * | 11/1996 | Stief et al. | 52/403.1 |
| 5,820,798 | A | | 10/1998 | Staten et al. | |
| 5,833,386 | A | * | 11/1998 | Rosan et al. | 404/36 |
| 5,971,655 | A | * | 10/1999 | Shirakawa | 404/40 |
| 6,199,340 | B1 | * | 3/2001 | Davis | 52/592.1 |
| 6,455,127 | B1 | * | 9/2002 | Valtanen | 428/137 |

FOREIGN PATENT DOCUMENTS

| | | |
|---|---|---|
| DE | 93 13 243 U | 12/1993 |
| WO | WO 98 17357 A | 4/1998 |

* cited by examiner

*Primary Examiner*—Carl D. Friedman
*Assistant Examiner*—Brian E. Glessner
(74) *Attorney, Agent, or Firm*—Adams Evans P.A.

(57) ABSTRACT

A cover assembly for temporarily covering areas such as an ice rink, to support people or other items thereon. The assembly comprises a number of components (10) which can be engaged with other such components (10) placed adjacent thereto-on the surface to be covered. The components include upper and lower parts (12, 16) with a gap (20) being provided between such parts to provide insulation from the underlying area. Adjacent components (10) are retained together by locking means (22) which are provided on two adjacent sides of each component (10). and are selectively engageable in recesses (32) on adjacent components (10).

28 Claims, 3 Drawing Sheets

COVER ASSEMBLY

TECHNICAL FIELD AND BACKGROUND OF THE INVENTION

This application is a national stage application, according to Chapter II of the Patent Cooperation Treaty. This application claims the priority date of Apr. 6, 1999 for Great Britain Patent Application No. 9907607.7.

This invention concerns a cover assembly, and particularly but not exclusively an area for covering an area of ice such as for example at an ice rink.

To make full use of venues such as ice rinks it is often desirable for the ice to be covered to permit activities to take place other than on ice. Such activities may comprise other sports such as boxing or basketball, or concerts or other performances. A number of arrangements have been proposed to temporarily cover ice, but in general these have not been wholly satisfactory. For example, some do not provide sufficient insulation, and others have proved quite expensive.

SUMMARY OF THE INVENTION

According to the present invention there is provided a cover assembly, the assembly comprising a plurality of components engageable adjacent each other to cover the ground or another surface, each component comprising an upper and lower part, each component being arranged such that the upper part defines an at least generally planar upper surface upon which a person can be supported, the lower part being engageable with the ground or other surface, with a gap being provided between the lower and upper parts to provide insulation and such that the upper part is spaced from the ground or other surface.

A plurality of spaced formations are preferably provided on one of the upper or lower parts and supportingly engageable with the other of said parts to space said parts apart. The formations are preferably provided in a regular pattern, and/or may be substantially frusto conical. The formations are preferably provided on the lower part. The lower part is preferably at least generally planar. The lower part may be formed from a single sheet of material with the formations being provided by shaping of the sheet.

The gap provided between the lower and upper parts is preferably filled with insulating means. which may be a foamed material and desirably polyurethane foam. Alternatively, the gap may be filled with air.

One or more openings may be provided extending into the gap to permit venting thereof.

The support surface of the upper part may be contoured, and may be contoured to aid the grip of persons walking thereon. Preferably formations are provided on the support surface to aid the grip of persons walking thereon.

Each component may be of substantially rectangular shape and may be substantially square.

Locking means may be provided for selectively retaining together adjacent components. The locking means may be provided on some of the sides, and desirably two of the sides, of the component. A plurality of locking means may be provided along each said side.

The locking means may comprise a locking member mounted on the component to be movable between a locked position extending generally laterally from the component so as to be engageable with an adjacent component, and an unlocked position contained substantially wholly within the component. The locking member is preferably pivotally mounted on the component. The locking member may comprise a curved engagement part, which engagement part may be substantially arcuate.

Recesses or other formations may be provided on the sides of the component with which the locking means is engageable.

Overlapping means may be provided on at least some of the sides of the component to cover any gap between adjacent components. The overlapping means may be provided on the sides without locking means, the overlapping means may comprise flanges.

The components may be made of plastics material and may be made of HDPE (High Density Polyethylene). The components may be made by twin sheet thermoforming, and the upper and lower parts may be integrally formed.

The invention also provides a component usable in a cover assembly according to any of the preceding eleven paragraphs.

The invention yet further provides a temporary cover for ice, the cover being in the form of an assembly according to any of said preceding eleven paragraphs.

BRIEF DESCRIPTION OF THE DRAWINGS

An embodiment of the present invention will now be described by way of example only and with reference to the accompanying drawings, in which.

DESCRIPTION OF THE PREFERRED EMBODIMENT AND BEST MODE

The Drawings show a component 10 usable in a cover assembly according to the invention suitable for instance for temporarily covering an ice rink. The component 10 has a generally square configuration with an upper part 12 defining an upper surface 14 which can support people or other items thereon. The surface 14 may have any suitable formations (not shown) thereon to aid the grip of people walking on the component 10. Such formations may be in the form of raised chevron shaped formations to create a non-slip surface.

Figure 4:
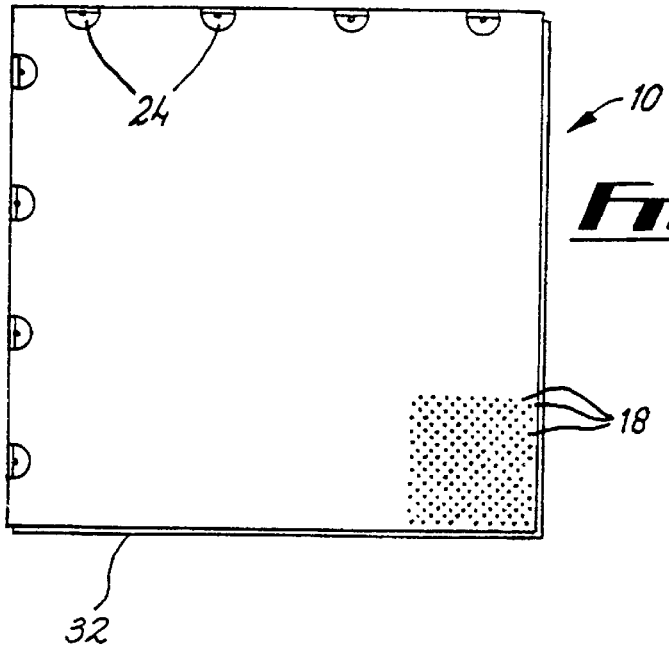
FIG. 4 is a view from beneath of the component of FIG. 2.
Figure 5:
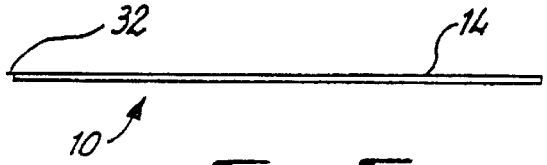
FIG. 5 is a side view of the component of FIG. 2.
Figure 6:
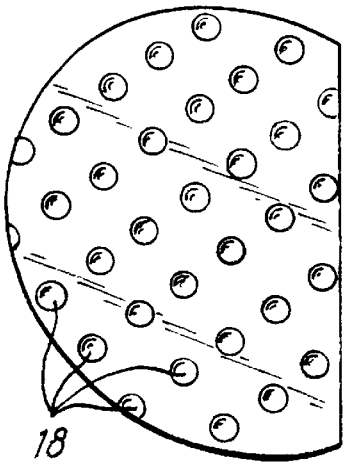
FIG. 6 is a more detailed view from underneath of part of the component of FIG. 2.
Figure 7:
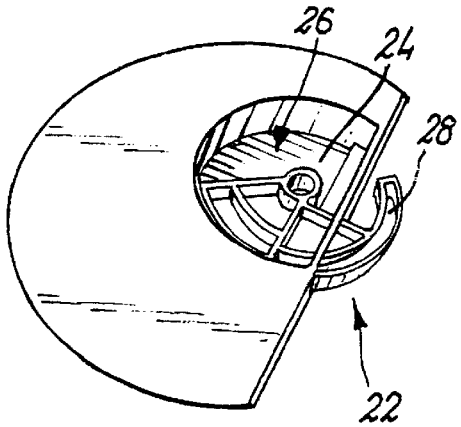
FIG. 7 is a more detailed view from beneath of a further part of the component of FIG. 1.

The component 10 also has a lower part 16 which is generally planar apart from a plurality of spaced upwardly extending frusto conical hollow projections 18 which extend to meet and support the upper part 12, and a number of locking recesses (see below). The upper and lower parts 12,18 define a gap 20 therebetween. Side walls are also provided for the component 10 such that the gap 20 is substantially sealed apart from a small number of vent holes (not shown) which are provided. The projections 18 provide a generally dimpled effect on the underside of the component 10 (see FIGS. 4 and 6). The gap 20 can be filled with an insulating material such as polyurethane foam, or with air.

Figure 1:
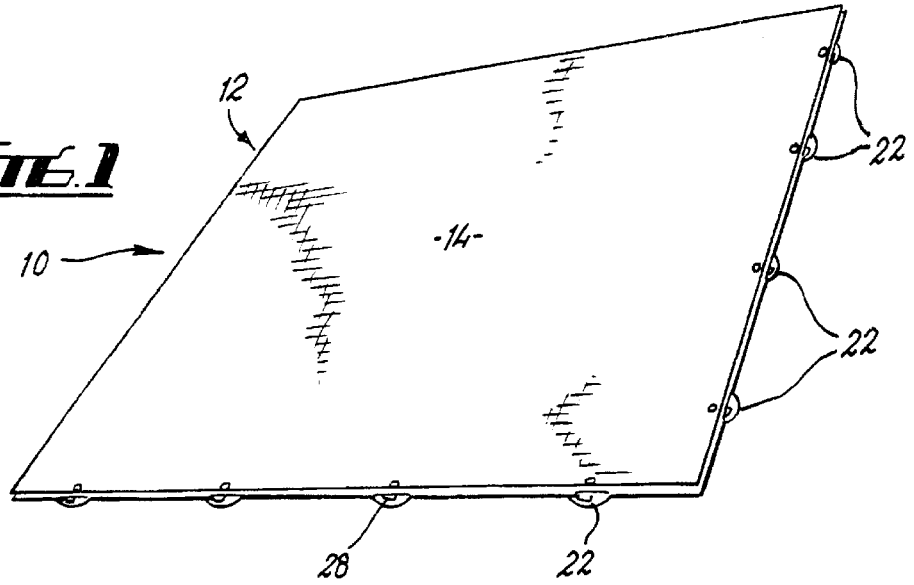
FIG. 1 is a perspective view of a cover assembly component according to the invention in a first locked condition.
Figure 2:
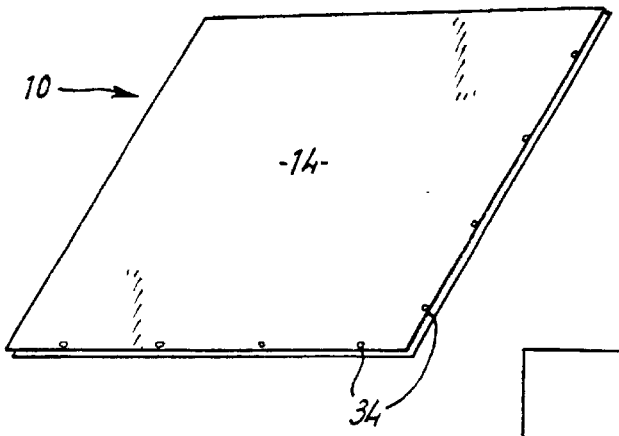
FIG. 2 is a perspective view of the component of FIG. 1 in a second unlocked condition.
Figure 3:
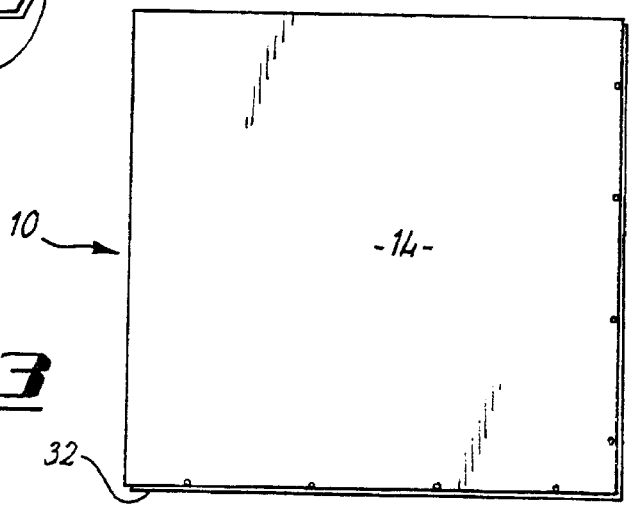
FIG. 3 is a plan view of the component of FIG. 2.
Figure 8:
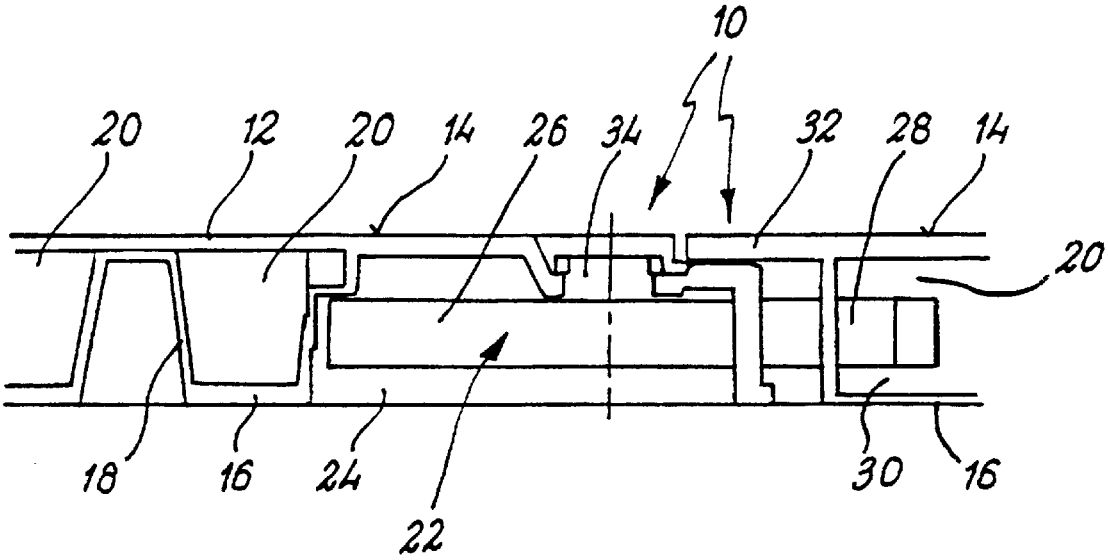
FIG. 8 is a more detailed cross-sectional view through parts of two adjacent engaged components according to the invention.

Four spaced locking means 22 (not shown on FIG. 4) are provided on each of two adjacent sides of the component 10. The locking means 22 comprises a part circular downwardly open recess 24 in which is pivotally mounted a locking member 26. The member 26 is arranged to substantially wholly locate within the recess 24 in a closed position (FIG. 2) but have an arcuate finger 28 thereon extending from the recess 24 when in a locked position (FIG. 1). Recesses 30 are provided at similar spacings on the other sides of the component 10. FIG. 8 shows two components 10 with the locking means 22 on the left hand component 10 engageable with the recess 30 on the right hand component.

A flange 32 is provided substantially co-planar with the upper surface 14 the two sides of the component 10 which do not have locking means 22. The flanges 32 ensure that no gap exists between the sides of adjacent components 10 in use.

The components 10 are formed by twin sheet thermoforming of HDPE with the upper and lower parts 12,16 integrally formed. The locking members 26 are subsequently pivotally mounted thereon by fingers 34 which rotatably locate in holes in the upper part 12. The fingers 34 are provided on their upper ends which are substantially coplanar with the surface 14, with a recess (not shown) to permit rotation thereof by a tool, and hence locking or unlocking by a person standing on the surface 14.

In use, any required number of components 10 can be mounted together to cover for instance an ice rink. The adjacent components 10 can readily be locked together by the locking means 22 by a person standing on or adjacent the components 10, and using a tool to engage with the fingers 34. The components 10 can be separated from each other and subsequently removed in a similar straightforward manner. The provision of the gap 20 filled with air or polyurethane foam between the upper and lower parts 12,16, and also beneath the projections 18, provides for very good insulation from the cold of the ice. Furthermore, the use of HDPE also provides good insulation. There is thus described a cover assembly which permits an ice rink or other surface to readily be covered whilst providing good insulation against the cold ice. The cover assembly is relatively strong yet can be inexpensively manufactured.

Various modifications may be made without departing from the scope of the invention. For example different formations could be provided extending between the upper and lower parts. Different locking means could be used. The components could be made of different materials and/or a different shape. Insulating materials other than polyurethane foam, such as other foamed materials, could be used to fill the gap between the upper and lower parts.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. A cover assembly comprising a plurality of components (10) engagable adjacent each other to cover the ground or another surface, each component (10) comprising an upper (12) and lower part (16), each component (10) being arranged such that the upper part (12) defines an at least generally planar upper surface (14) upon which a person can be supported, the lower part (16) being engagable with the ground or other surface, with a gap (20) being provided between the lower and upper parts (16, 12) to provide insulation and such that the upper part (12) is spaced from the ground or other surface, overlapping means (32) being provided on at least some of the sides of the component (10) to cover any gap between adjacent components (10), locking means (22) being provided for selectively retaining together adjacent components (10), the locking means (22) comprising a locking member (26) mounted on the component (10) to be movable between a locked position extending generally laterally from the component (10) so as to be engagable with an adjacent component (10), and an unlocked position contained substantially wholly within the component (10).

2. A cover assembly according to claim 1, characterised in that a plurality of spaced formations are provided on one of the upper or lower parts (12, 16) and supportingly engageable with the other of said parts to space said parts (12, 16) apart.

3. A cover assembly according to claim 2, characterised in that the formations are provided in a regular pattern.

4. A cover assembly according to claim 2, characterised in that the formations are substantially frusto conical.

5. A cover assembly according to claim 2, characterised in that the formations (18) are provided on the lower part (16).

6. A cover assembly according to claim 5, characterised in that the lower part (16) is at least generally planar.

7. A cover assembly according to claim 6, characterised in that the lower part (16) is formed from a single sheet of material with the formations (18) being provided by shaping of the sheet.

8. A cover assembly according to claim 1, characterised in that the gap (20) provided between the lower and upper parts (16, 12) is filled with insulating means.

9. A cover assembly according to claim 1, characterised in that the gap is filled with air.

10. A cover assembly according to claim 1, characterised in that the support surface (14) of the upper part (12) is contoured.

11. A cover assembly according to claim 10, characterised in that the support surface (14) is contoured to aid the grip of persons walking thereon.

12. A cover assembly according to claim 1, characterised in that each component (10) is of substantially rectangular shape.

13. A cover assembly according to claim 12, characterised in that each component (10) is substantially square.

14. A cover assembly according to claim 1, charaterised in that the locking means (22) are provided on some of the sides of the component (10).

15. cover assembly according to claim 14, characterised in that the locking means (22) are provided on two of the sides of the component (10).

16. A cover assembly according to claim 14, characterised in that a plurality of locking means (22) are provided along each said side.

17. A cover assembly according to claim 1, characterised in that the locking member (26) is pivotally mounted on the component (10).

18. A cover assembly according to claim 1, characterised in that the locking member (26) comprises a curved engagement part (28).

19. A cover assembly according to claim 18, characterised in that the engagement part (28) may be substantially arcuate.

20. A cover assembly according to claim 1, characterised in that recesses (30) or other formations are provided on the sides of the component with which the locking means (22) is engageable.

21. A cover assembly according to claim 1, characterised in that the overlapping means (32) are provided on the sides without locking means (22).

22. A cover assembly according to claim 1, characterised in that the overlapping means (32) comprises flanges.

23. A cover assembly according to claim 1, characterised in that the components (10) are made of plastics material.

24. A cover assembly according to claim 23, characterised in that the components (10) are made of HDPE (High Density Polyethylene).

25. A cover assembly according to claim 23, characterised in that the components (10) are made by twin sheet thermoforming.

26. A cover assembly according to claim 25, characterised in that the upper and lower parts (12, 16) are integrally formed.

27. A component usable in a cover assembly according claim 1.

28. A temporary cover for ice, the cover being in the form of an assembly according to claim 1.

* * * * *